US012209415B1

(12) United States Patent
Rhodig

(10) Patent No.: US 12,209,415 B1
(45) Date of Patent: Jan. 28, 2025

(54) GLAZING AND CONDENSATION SYSTEM FOR SOLAR AND GLASS ROOF PANELS FOR SOLAR ENERGY-PRODUCING COVERS

(71) Applicant: Access at Home Inc., Washougal, WA (US)

(72) Inventor: Anthony K. Rhodig, Washougal, WA (US)

(73) Assignee: Access at Home Inc., Washougal, OR (US)

( * ) Notice: Subject to any disclaimer, the term of this patent is extended or adjusted under 35 U.S.C. 154(b) by 208 days.

(21) Appl. No.: 17/953,160

(22) Filed: Sep. 26, 2022

Related U.S. Application Data

(60) Provisional application No. 63/250,875, filed on Sep. 30, 2021.

(51) Int. Cl.
*E04D 3/08* (2006.01)

(52) U.S. Cl.
CPC ..... *E04D 3/08* (2013.01); *E04D 2003/0868* (2013.01); *E04D 2003/0893* (2013.01)

(58) Field of Classification Search
CPC .... E04D 3/06; E04D 3/08; E04D 3/16; E04D 3/3605; E04D 3/38; E04D 2003/0806; E04D 2003/0812; E04D 2003/0843; E04D 2003/085; E04D 2003/0862; E04D 2003/0887; E04D 2003/0893; E04D 13/0404; E04D 13/0409; E04D 13/0445; E04D 2013/049
See application file for complete search history.

(56) References Cited

U.S. PATENT DOCUMENTS 2,182,852 A 12/1939 Willard
3,310,926 A 3/1967 Brandreth et al.
(Continued)

FOREIGN PATENT DOCUMENTS

EP 1239096 A2 9/2002
GB 2399107 B 7/2006
(Continued)

*Primary Examiner* — Kyle J. Walraed-Sullivan
(74) *Attorney, Agent, or Firm* — Renaissance IP Law Group, LLP; David A. Crowther

(57) ABSTRACT

A glazing and condensation system for roof panels comprises mullions and purlins. Roof panels are disposed above the mullion. A section of double-sided tape is disposed between a first roof panel and the mullion. A section of double-sided tape is disposed between a second roof panel and the mullion. The roof panels can be solar roof panels and/or glass roof panels. A first condensation collection channel is arranged beneath the first roof panel. A second condensation collection channel is arranged beneath the second roof panel. A third condensation collection channel is arranged perpendicular to the mullion, beneath the first roof panel, and above the first condensation collection channel. A fourth condensation collection channel is arranged perpendicular to the mullion, beneath the second roof panel, and above the second condensation collection channel. The condensation collection channels collect condensation and/or drippage from roof panels, and cause condensation and/or drippage to be channeled away from a solar cover. A wire casing includes wires that are connected to solar roof panels.

14 Claims, 11 Drawing Sheets

(56) References Cited

U.S. PATENT DOCUMENTS

| | | | | | |
|---|---|---|---|---|---|
| 3,830,029 | A * | 8/1974 | Vance | E04D 3/06 | 52/669 |
| 4,438,680 | A | 3/1984 | Esposito | | |
| 4,598,752 | A | 7/1986 | Esposito | | |
| 4,621,472 | A * | 11/1986 | Kloke | E04D 3/08 | 52/204.591 |
| 4,680,905 | A | 7/1987 | Rockar | | |
| 4,691,489 | A * | 9/1987 | Shea, Jr. | E06B 3/5427 | 52/204.593 |
| 4,745,723 | A | 5/1988 | Esposito | | |
| 5,394,664 | A | 3/1995 | Nowell | | |
| 5,687,524 | A * | 11/1997 | Ting | E04D 3/06 | 52/235 |
| 6,082,071 | A | 7/2000 | Richardson | | |
| 6,161,346 | A | 12/2000 | Richardson | | |
| 7,832,160 | B2 | 11/2010 | Farag | | |
| 2010/0313506 | A1 * | 12/2010 | Schoell | F24S 40/44 | 52/302.1 |
| 2016/0230392 | A1 * | 8/2016 | Tang | C09J 7/243 | |
| 2020/0266754 | A1 * | 8/2020 | Ferris | F24S 25/634 | |

FOREIGN PATENT DOCUMENTS

| | | | |
|---|---|---|---|
| WO | 1993025779 | A1 | 12/1993 |
| WO | 2006095201 | A1 | 9/2006 |

* cited by examiner

GLAZING AND CONDENSATION SYSTEM FOR SOLAR AND GLASS ROOF PANELS FOR SOLAR ENERGY-PRODUCING COVERS

RELATED APPLICATION DATA

This application claims the benefit of U.S. Provisional Patent Application Ser. No. 63/250,875, filed on Sep. 30, 2021, which is hereby incorporated by reference.

TECHNICAL FIELD

This application pertains to solar and glass systems, and more particularly, to a glazing and condensation system for solar and glass roof panels for solar energy-producing covers.

BACKGROUND

Solar energy-producing covers constructed next to homes and buildings are becoming more popular as society moves toward an energy-efficient paradigm. Some covers include regular glass panels, whereas others include solar panels. One of the primary challenges with such covers is their propensity to begin leaking water, thereby defeating their function as a cover. The leaking can be caused by moisture condensate, seal failures, extreme weather, unsuitable construction materials, or the like.

Accordingly, a need remains for improved construction methods and systems for solar energy-producing covers. Embodiments of the inventive concept address these and other limitations in the prior art.

The foregoing and other features of the inventive concept will become more readily apparent from the following detailed description, which proceeds with reference to the accompanying drawings.

DETAILED DESCRIPTION OF THE EMBODIMENTS

Reference will now be made in detail to embodiments of the inventive concept, examples of which are illustrated in the accompanying drawings. The accompanying drawings are not necessarily drawn to scale. In the following detailed description, numerous specific details are set forth to enable a thorough understanding of the inventive concept. It should be understood, however, that persons having ordinary skill in the art may practice the inventive concept without these specific details. In other instances, well-known methods, procedures, components, circuits, and networks have not been described in detail so as not to unnecessarily obscure aspects of the embodiments.

It will be understood that, although the terms first, second, etc. may be used herein to describe various elements, these elements should not be limited by these terms. These terms are only used to distinguish one element from another. For example, a first solar panel could be termed a second solar panel, and, similarly, a second solar panel could be termed a first solar panel, without departing from the scope of the inventive concept.

It will be understood that when an element or layer is referred to as being "on," "coupled to," or "connected to" another element or layer, it can be directly on, directly coupled to or directly connected to the other element or layer, or intervening elements or layers may be present. In contrast, when an element is referred to as being "directly on," "directly coupled to," or "directly connected to" another element or layer, there are no intervening elements or layers present. Like numbers refer to like elements throughout. As used herein, the term "and/or" includes any and all combinations of one or more of the associated listed items.

The terminology used in the description of the inventive concept herein is for the purpose of describing particular embodiments only and is not intended to be limiting of the inventive concept. As used in the description of the inventive concept and the appended claims, the singular forms "a," "an," and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Figure 1:
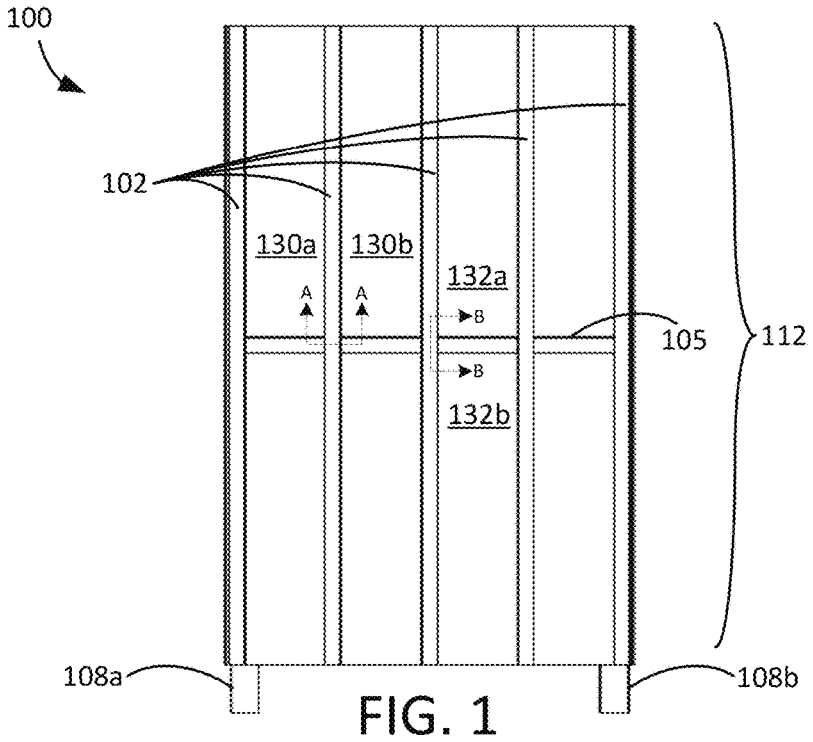
FIG. 1 illustrates top view of an example solar energy-producing cover including an example glazing and condensation system for solar and glass roof panels in accordance with various embodiments of the present inventive concept.

FIG. 1 illustrates top view of an example solar energy-producing cover 100 including an example glazing and condensation system 112 for solar and glass roof panels (e.g., 130*a*, 130*b*, 132*a*, 132*b*) in accordance with various embodiments of the present inventive concept. The glazing and condensation system 112 can include one or more solar panels (e.g., 130*a*, 130*b*, 132*a*, 132*b*). It will be understood that while reference is generally made herein to solar panels, glass panels can be used in place of or in addition to solar panels. In other words, the glazing and condensation system 112 can include one or more solar panels, one or more glass panels, or any combination thereof.

The glazing and condensation system 112 can include one or more mullions 102, and one or more purlins 105, for example. It will be understood that the glazing and condensation system 112 can include any suitable number of mullions, purlins, solar panels, glass panels, or the like, as described in detail herein.

Figure 2:
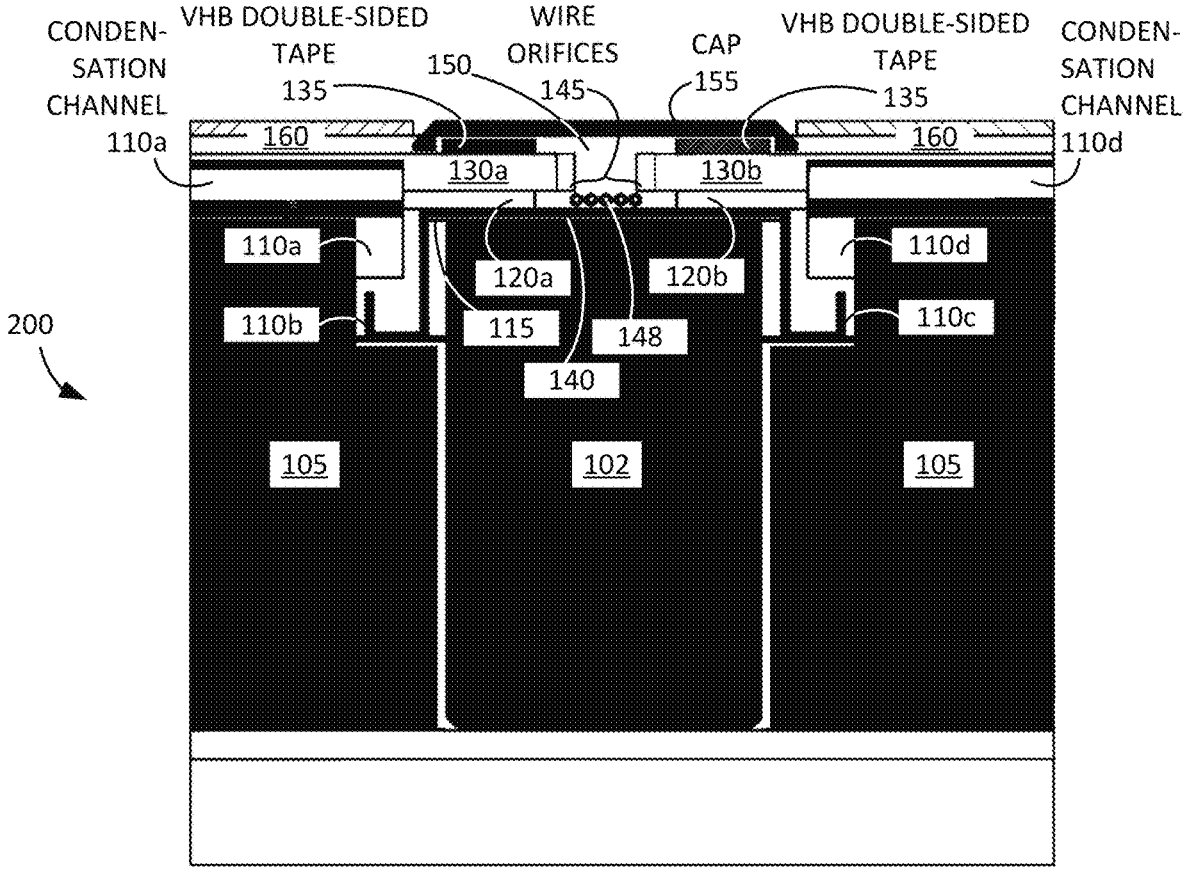
FIG. 2 illustrates a cross-sectional side elevation view 200 taken along lines A-A of the example glazing and condensation system of FIG. 1 in accordance with various embodiments of the present inventive concept.

FIG. 2 illustrates a cross-sectional side elevation view taken along lines A-A of the example glazing and condensation system 112 of FIG. 1 in accordance with various embodiments of the present inventive concept.

The glazing and condensation system 112 can include a mullion threshold cap 155 that is disposed atop at least a portion of the one or more solar panels (e.g., 130*a*, 130*b*). The mullion threshold cap 155 can be made of aluminum, coated steel, and/or other suitable weather-resistant material. The mullion threshold cap 155 can be affixed to the one or more solar panels (e.g., 130*a*, 130*b*) using double-sided tape 135. Preferably, the double-sided tape 135 is at least 0.15 millimeters thick. Preferably, the double-sided tape 135 has a tensile strength of at least 70 lbs/inch$^2$. Preferably, the double-sided tape 135 has a peel adhesion of at least 14 lbs/inch. The double-sided tape 135 can be Very High Bond Tape such as 3M™ VHB™ tape. Accordingly, it is not necessary to use fasteners to secure the one or more solar panels (e.g., 130*a*, 130*b*), which increases the efficiency of construction and installation, and also forms a tight seal. The glazing and condensation system 112 can include one or more condensation collection channels (e.g., 110*a*, 110*b*, 110*c*, 110*d*). The one or more condensation collection channels (e.g., 110*a*, 110*b*, 110*c*, 110*d*) can accumulate and drain water condensation, drippage, or other liquid away from the one or more solar panels (e.g., 130*a*, 130*b*, 132*a*, 132*b*) and away from the solar energy-producing cover 100. The condensation, drippage, or other liquid can come off of the underside of the one or more solar panels (e.g., 130*a*, 130*b*, 132*a*, 132*b*), and caught by the one or more condensation collection channels (e.g., 110*a*, 110*b*, 110*c*, 110*d*). A first subset (e.g., 110*a*, 110*d*) of the condensation collection channels can run perpendicular to second subset (e.g., 110*b*, 110*c*) of the condensation collection channels. The first subset (e.g., 110*a*, 110*d*) of the condensation collection channels can empty into the second subset (e.g., 110*b*, 110*c*) of the condensation collection channels. In some embodiments, the first subset (e.g., 110*a*, 110*d*) of the condensation collection channels are at a higher elevation than the second subset (e.g., 110*b*, 110*c*) of the condensation collection channels, so that the condensation or other drippage can flow by the force of gravity from the higher elevation condensation collection channels into the lower elevation condensation collection channels. In some embodiments, the force of gravity causes the condensation or other drippage to continue to flow through the lower elevation condensation collection channels and off of the solar energy-producing cover 100. The one or more condensation collection channels (e.g., 110*a*, 110*b*, 110*c*, 110*d*) can be made from extruded aluminum and/or coated steel.

The glazing and condensation system 112 can include a wire casing 150. The wire casing 150 can include or otherwise enclose one or more wire orifices 145, which can hold one or more wires (e.g., 148) associated with the one or more solar panels (e.g., 130*a*, 130*b*). In other words, the one or more wires (e.g., 148) can be disposed through the one or more wire orifices 145. The one or more wire orifices 145 can extend along the length of the wire casing 150. The wire casing 150 can extend along the length of a roof section of the solar energy-producing cover 100. The glazing and condensation system 112 can include one or more mullions 102, and can include one or more purlins 105. In some embodiments, the wire casing 150 can be at least partially grooved (not shown) into a top region of the mullion 102 to allow more room for the one or more wires 148. In some embodiments, the wire casing 150 can be at least partially grooved into a top region of the purlin 105 to allow more room for the one or more wires 148.

The glazing and condensation system 112 can include a mullion cap 115 disposed underneath the one or more solar panels (e.g., 130*a*, 130*b*), and disposed atop the mullion 102. The mullion cap 115 can be made of aluminum, steel, other metal, or any other durable water-tight material. In some embodiments, the mullion cap 115 and the one or more condensation collection channels (e.g., 110*a*, 110*b*, 110*c*, 110*d*) are a singular part. In some embodiments, the mullion cap 115 can be affixed to the mullion 102 using double-sided tape 140. The double-sided tape 140 can be Very High Bond Tape such as 3M™ VHB™ tape. In addition, double-sided tape 160 such as the 3M™ VHB™ tape can be disposed atop the one or more purlins 105, adjacent to the mullion threshold cap 155.

One or more fillers (e.g., 120*a*, 120*b*) can be disposed between the one or more solar panels (e.g., 130*a*, 130*b*) and the mullion 102. In some embodiments, the one or more fillers (e.g., 120*a*, 120*b*) are Very High Bond Tape such as the 3M™ VHB™ tape. In some embodiments, the one or more fillers (e.g., 120*a*, 120*b*) are made of another filler material such as plastic, foam, metal, or the like. The one or more solar panels (e.g., 130*a*, 130*b*) and/or the wire casing 150 can be affixed to the mullion cap 115 atop the mullion 102 using the double-sided tape (e.g., 120*a*, 120*b*). In some embodiments, the glazing and condensation system 112 does not include the one or more condensation collection channels (e.g., 110*a*, 110*b*, 110*c*, 110*d*), but can still include the wire casing 150 and the double-sided tapes 135, 140, 120*a*, and/or 120*b*.

The condensation collection channel 110*a* can be arranged substantially perpendicular to the condensation collection channel 110*b*, and can drain water condensation or other liquid in a direction that is substantially perpendicular to the condensation collection channel 110*b*. Similarly, the condensation collection channel 110*d* can be arranged substantially perpendicular to the condensation collection channel 110*c*, and can drain water condensation or other liquid in a direction that is substantially perpendicular to the condensation collection channel 110*c*. The glazing and condensation system 112 can include a purlin 105 that can extend in a direction that is substantially perpendicular to the mullion 102. The one or more mullions 102 and the one or more purlins 105 can be constructed of wood, metal, plastic, glass, fiber glass, or other suitable construction materials. The one or more mullions 102 and the one or more purlins 105 can be combined to form a frame of the solar energy-producing cover 100. The frame can be made of timber, aluminum, steel, plastic, fiber glass, glass, and/or other suitable rigid constructions materials.

Figure 3:
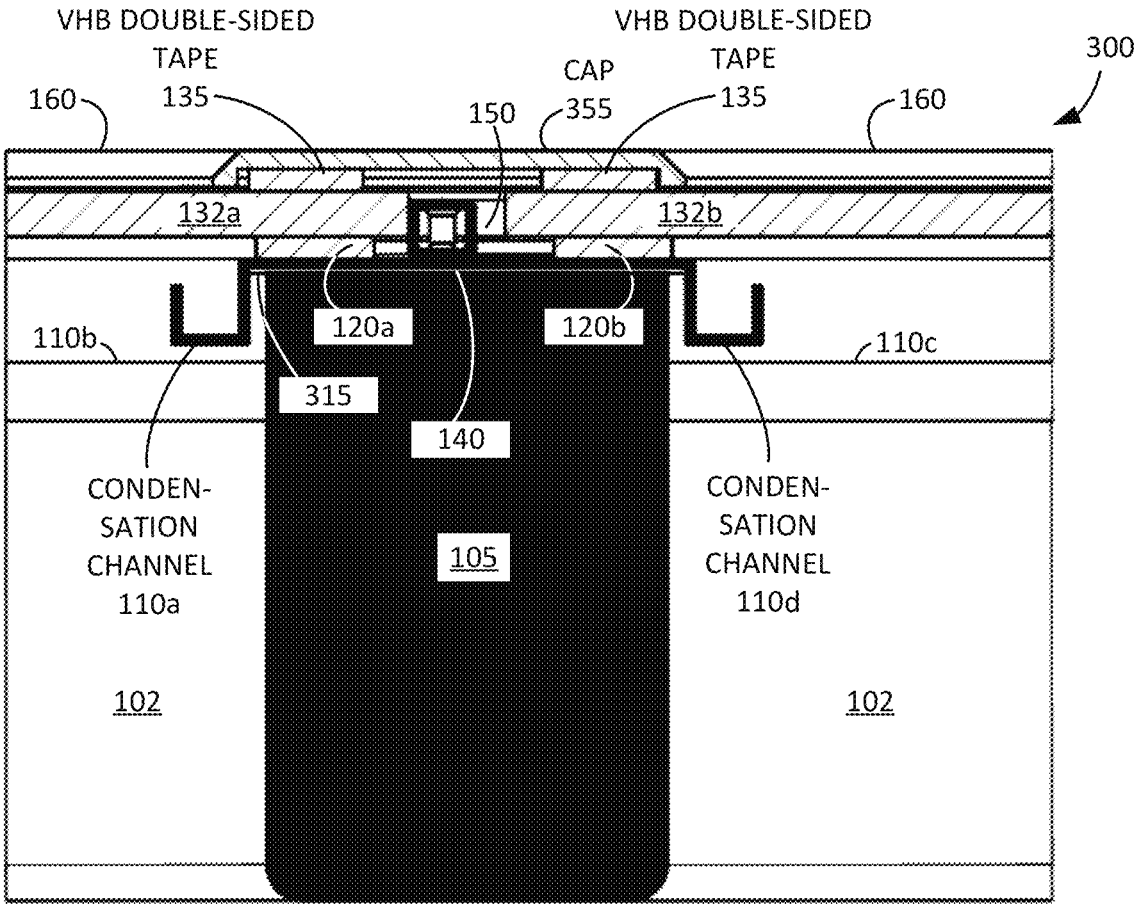
FIG. 3 illustrates a cross-sectional side elevation view 300 taken along lines B-B of the example glazing and condensation system of FIG. 1 in accordance with various embodiments of the present inventive concept.

FIG. 3 illustrates a cross-sectional side elevation view taken along lines B-B of the example glazing and condensation system 112 of FIG. 1 in accordance with various embodiments of the present inventive concept.

The glazing and condensation system 112 can include a purlin threshold cap 355 that is disposed atop at least a portion of the one or more solar panels (e.g., 132*a*, 132*b*). The purlin threshold cap 355 can be made of aluminum, coated steel, and/or other suitable weather-resistant material. The purlin threshold cap 355 can be affixed to the one or more solar panels (e.g., 130*a*, 130*b*, 132*a*, 132*b*) using double-sided tape 135. The double-sided tape 135 can be Very High Bond Tape such as 3M™ VHB™ tape. Accordingly, it is not necessary to use fasteners to secure the one or more solar panels (e.g., 130*a*, 130*b*, 132*a*, 132*b*), which increases the efficiency of construction and installation, and also forms a tight seal. The one or more condensation collection channels (e.g., 110*a*, 110*b*, 110*c*, 110*d*) can accumulate and drain water condensation, drippage, or other liquid away from the one or more solar panels (e.g., 130*a*, 130*b*, 132*a*, 132*b*) and away from the solar energy-producing cover 100. The condensation, drippage, or other liquid can come off of the underside of the one or more solar panels (e.g., 130*a*, 130*b*, 132*a*, 132*b*), and caught by the one or more condensation collection channels (e.g., 110*a*, 110*b*, 110*c*, 110*d*). The first subset (e.g., 110*a*, 110*d*) of the condensation collection channels can run perpendicular to second subset (e.g., 110*b*, 110*c*) of the condensation collection channels. The first subset (e.g., 110*a*, 110*d*) of the condensation collection channels can empty into the second subset (e.g., 110*b*, 110*c*) of the condensation collection channels. In some embodiments, the first subset (e.g., 110*a*, 110*d*) of the condensation collection channels are at a higher elevation than the second subset (e.g., 110*b*, 110*c*) of the condensation collection channels, so that the condensation or other drippage can flow by the force of gravity from the higher elevation condensation collection channels into the lower elevation condensation collection channels. In some embodiments, the force of gravity causes the condensation or other drippage to continue to flow through the lower elevation condensation collection channels and off of the solar energy-producing cover 100. The one or more condensation collection channels (e.g., 110*a*, 110*b*, 110*c*, 110*d*) can be made from extruded aluminum and/or coated steel.

The glazing and condensation system 112 can include the wire casing 150, which is shown in FIG. 3 running in the horizontal direction. Thus, the one or more wire orifices 145 that hold one or more wires (e.g., 148) are not visible in FIG. 3. The glazing and condensation system 112 can include the one or more mullions 102, and can include the one or more purlins 105. In some embodiments, the wire casing 150 can be at least partially grooved (not shown) into a top region of the one or more purlins 105 to allow more room for the one or more wires 148. In some embodiments, the wire casing 150 can be at least partially grooved into a top region of the mullion 102 to allow more room for the one or more wires 148.

The glazing and condensation system 112 can include a purlin cap 315 disposed underneath the one or more solar panels (e.g., 130*a*, 130*b*, 132*a*, 132*b*), and disposed atop the purlin 105. The purlin cap 315 can be made of aluminum, steel, other metal, or any other durable water-tight material. In some embodiments, the purlin cap 315 and the one or more condensation collection channels (e.g., 110*a*, 110*b*, 110*c*, 110*d*) are a singular part. In some embodiments, the purlin cap 315 can be affixed to the purlin 105 using double-sided tape 140. The double-sided tape 140 can be Very High Bond Tape such as 3M™ VHB™ tape.

One or more fillers (e.g., 120*a*, 120*b*) can be disposed between the one or more solar panels (e.g., 132*a*, 132*b*) and the purlin 105. In some embodiments, the one or more fillers (e.g., 120*a*, 120*b*) are Very High Bond Tape such as the 3M™ VHB™ tape. In some embodiments, the one or more fillers (e.g., 120*a*, 120*b*) are made of another filler material such as plastic, foam, metal, or the like. The one or more solar panels (e.g., 132*a*, 132*b*) and/or the wire casing 150 can be affixed to the purlin cap 315 atop the purlin 105 using the double-sided tape (e.g., 120*a*, 120*b*). In some embodiments, the glazing and condensation system 112 does not include the one or more condensation collection channels (e.g., 110*a*, 110*b*, 110*c*, 110*d*), but can still include the wire casing 150 and the double-sided tapes 135, 140, 120*a*, and/or 120*b*.

The condensation collection channel 110*a* can be arranged substantially perpendicular to the condensation collection channel 110*b*, and can drain water condensation or other liquid in a direction that is substantially perpendicular to the condensation collection channel 110*b*. Similarly, the condensation collection channel 110*d* can be arranged substantially perpendicular to the condensation collection channel 110*c*, and can drain water condensation or other liquid in a direction that is substantially perpendicular to the condensation collection channel 110*c*. The purlin 105 can extend in a direction that is substantially perpendicular to the mullion 102. The one or more mullions 102 and the one or more purlins 105 can be constructed of wood, metal, plastic, glass, fiber glass, or other suitable construction materials. The one or more mullions 102 and the one or more purlins 105 can be combined to form a frame of the solar energy-producing cover 100. The frame can be made of timber, aluminum, steel, plastic, fiber glass, glass, and/or other suitable rigid constructions materials.

The glazing and condensation system 112 can create a watertight seal between the one or more solar panels (e.g., 130*a*, 130*b*, 132*a*, 132*b*) and the one or more condensation collection channels (e.g., 110*a*, 110*b*, 110*c*, 110*d*) for solar roofs and sun roofs. The glazing and condensation system 112 provides modular and efficient construction and installation, with a clean look to the roof structure that hides the one or more wires (e.g., 148) from view. The roof cover is pleasing to the eye. The one or more condensation collection channels (e.g., 110*a*, 110*b*, 110*c*, 110*d*) can catch condensation associated with the one or more solar panels (e.g., 130*a*, 130*b*) that would otherwise drip through the roof and onto occupants underneath the roof, or otherwise cause damage to the structure. The glazing and condensation system 112 can create a watertight seal on the one or more solar panels (e.g., 130*a*, 130*b*, 132*a*, 132*b*), thereby allowing their use as the primary roof cover similar to a sunroom with glass roof panels. In some embodiments, the glazing and condensation system 112 can be used with glass panels for sunroom roof panels. The glazing and condensation system 112 can be incorporated into patio covers, deck covers, carports, picnic structures, greenhouses, and/or any structure with a covered roof.

Figure 4:
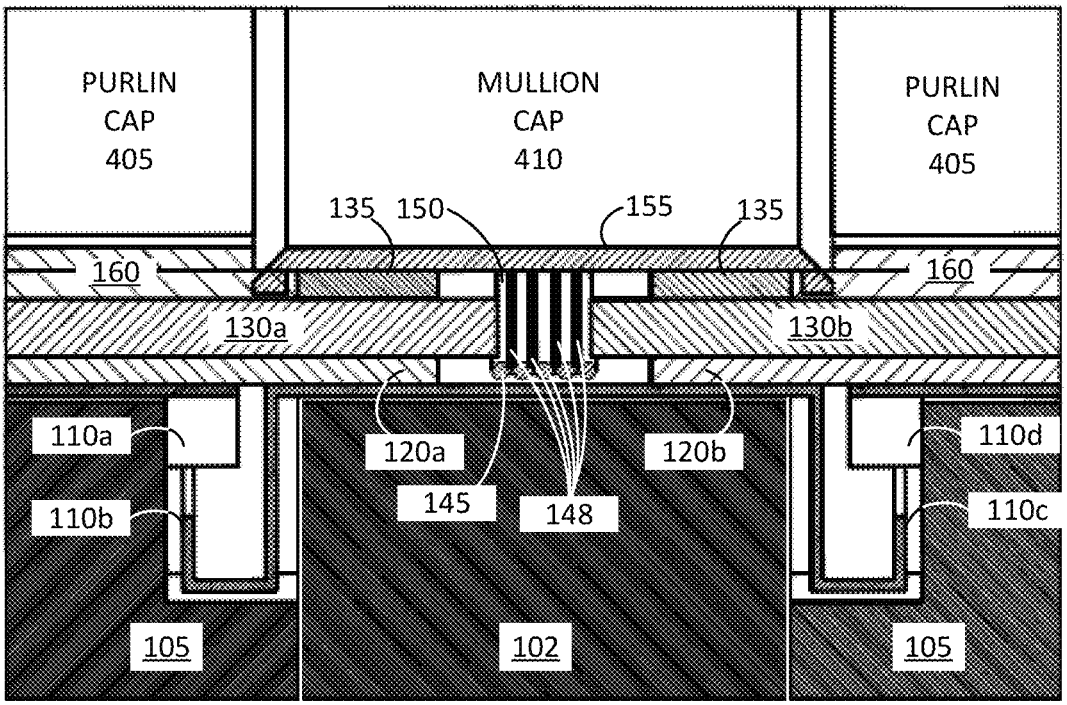
FIG. 4 illustrates an alternate example cross-sectional side elevation view taken along lines A-A of the example glazing and condensation system of FIG. 1 in accordance with various embodiments of the present inventive concept.

FIG. 4 illustrates an alternate example cross-sectional side elevation view taken along lines A-A of the example glazing and condensation system 112 of FIG. 1 in accordance with various embodiments of the present inventive concept. Some of the reference numerals are described above, and therefore, a detailed description is not necessarily repeated. Of notable difference, the cross-sectional side elevation view of FIG. 4 includes one or more mullion caps (e.g., 410) and one or more purlin caps (e.g., 405). The double-sided tape 160 such as the 3M™ VHB™ tape can be disposed between the one or more purlin caps 405 and the one or more purlins 105, and secure the one or more purlin caps 405 to the one or more purlins 105. In addition, as shown in FIG. 4, the one or more wires 148 can extend into or out of the one or more wire orifices 145 of the wire casing 150. The one or more wires 148 can be connected to the one or more solar panels (e.g., 130*a*, 130*b*, 132*a*, 132*b*).

Figure 5:
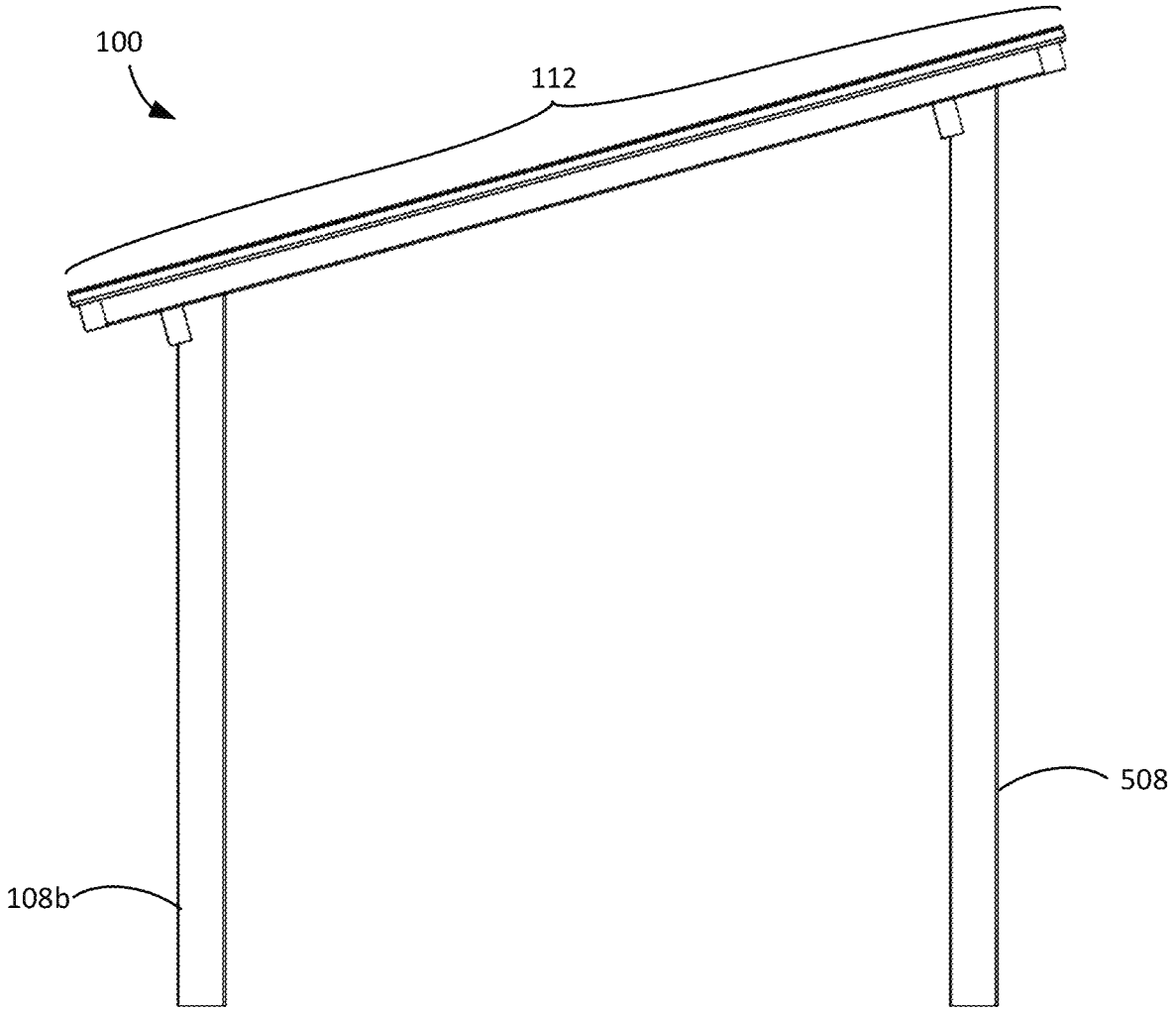
FIG. 5 illustrates a side elevation view of the solar energy-producing cover including the example glazing and condensation system for solar and glass roof panels in accordance with various embodiments of the present inventive concept.

FIG. 5 illustrates a side elevation view of the solar energy-producing cover 100 including the example glazing and condensation system 112 for solar and glass roof panels in accordance with various embodiments of the present inventive concept. The solar energy-producing cover 100 can include one or more beams (e.g., 108*b*, 508) to hold up and support the solar energy-producing cover 100. It will be understood that FIG. 4 shows a simplified cover, and in actuality, there may be multiple beams, mullions, purlins, solar panels, glass panels, or the like.

Figure 6:
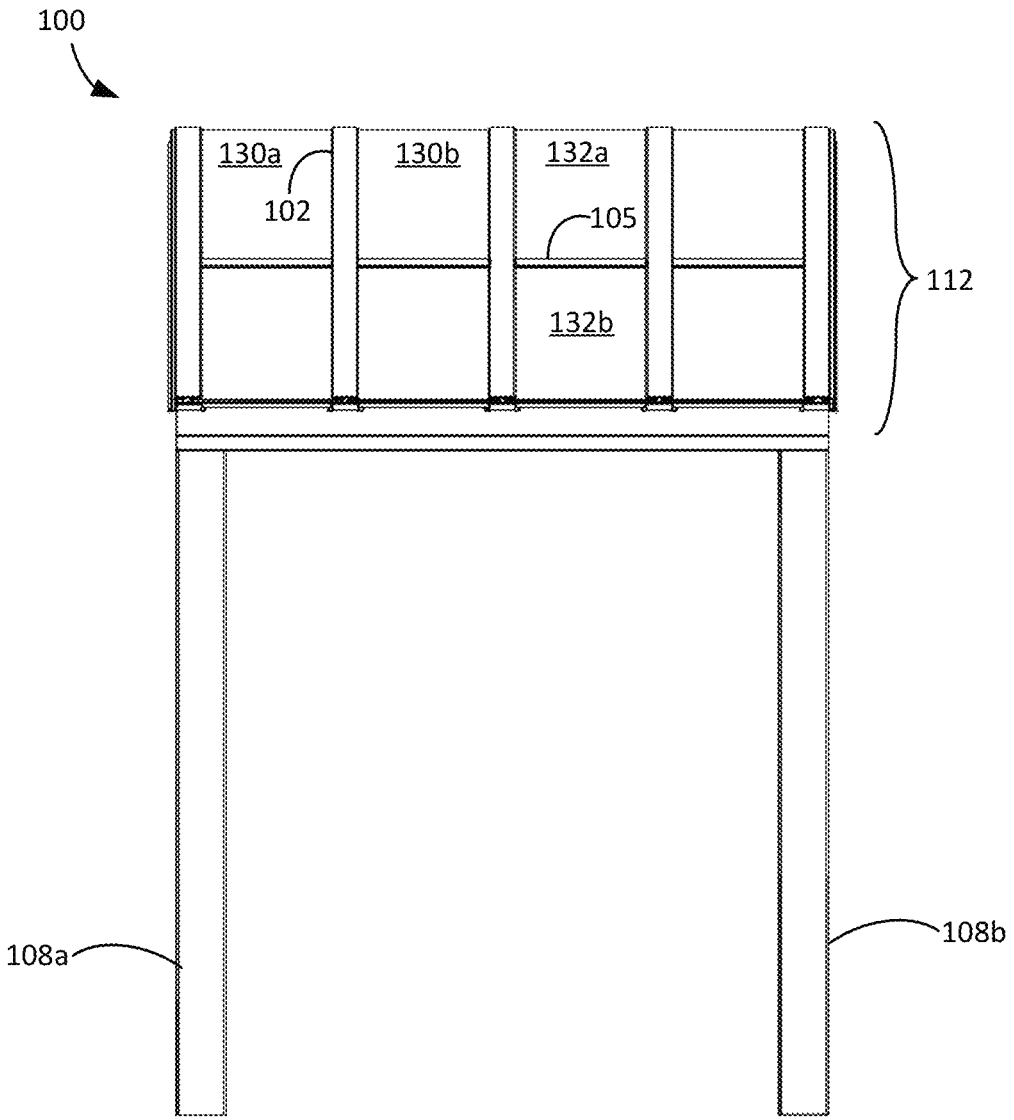
FIG. 6 illustrates a front elevation view of the solar energy-producing cover of FIG. 1 including the example glazing and condensation system for solar and glass roof in accordance with various embodiments of the present inventive concept.

FIG. 6 illustrates a front elevation view of the solar energy-producing cover 100 of FIG. 1 including the example glazing and condensation system 112 for solar and glass roof panels (e.g., 130*a*, 130*b*, 132*a*, 132*b*) in accordance with various embodiments of the present inventive concept. The solar energy-producing cover 100 can include one or more beams (e.g., 108*a*, 108*b*) to hold up and support the solar energy-producing cover 100. In addition, the solar energy-producing cover 100 can include the one or more mullions 102, and/or the one or more purlins 105, for example. The solar energy-producing cover 100 can include the solar panels 130*a*, 130*b*, 132*a*, 132*b*, for example. It will be understood that the solar energy-producing cover 100 can include any suitable number of mullions, solar panels, glass panels, or the like, as described in detail herein.

Figure 7:
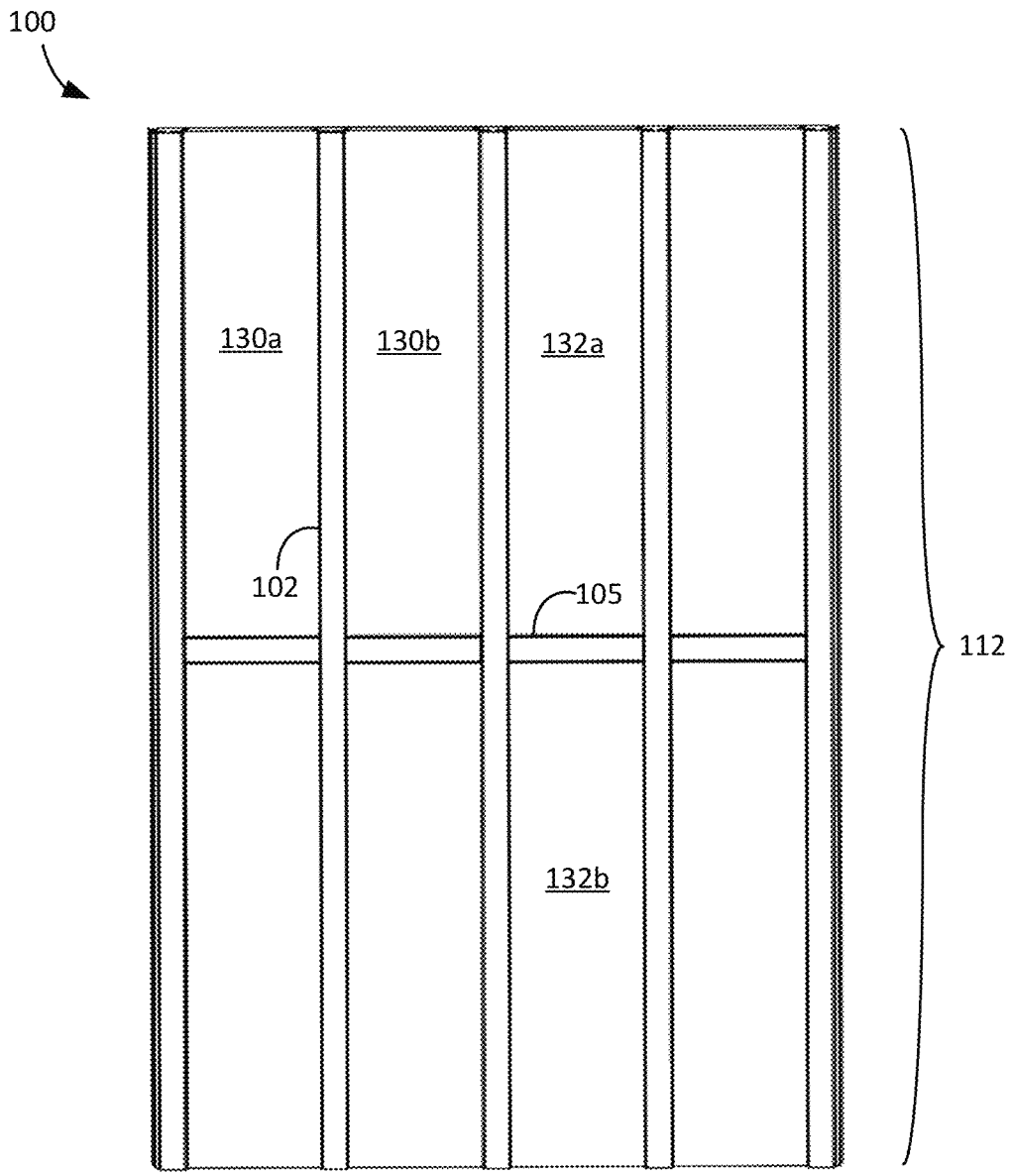
FIG. 7 illustrates a top view of the example glazing and condensation system for solar and glass roof panels of FIG. 1 for the solar energy-producing cover.

FIG. 7 illustrates a top view of the example glazing and condensation system 112 for solar and glass roof panels (e.g., 130*a*, 130*b*, 132*a*, 132*b*) of FIG. 1 for the solar energy-producing cover 100. It will be understood that the glazing and condensation system 112 can include any suitable number of solar panels and/or glass panels.

Figure 8:
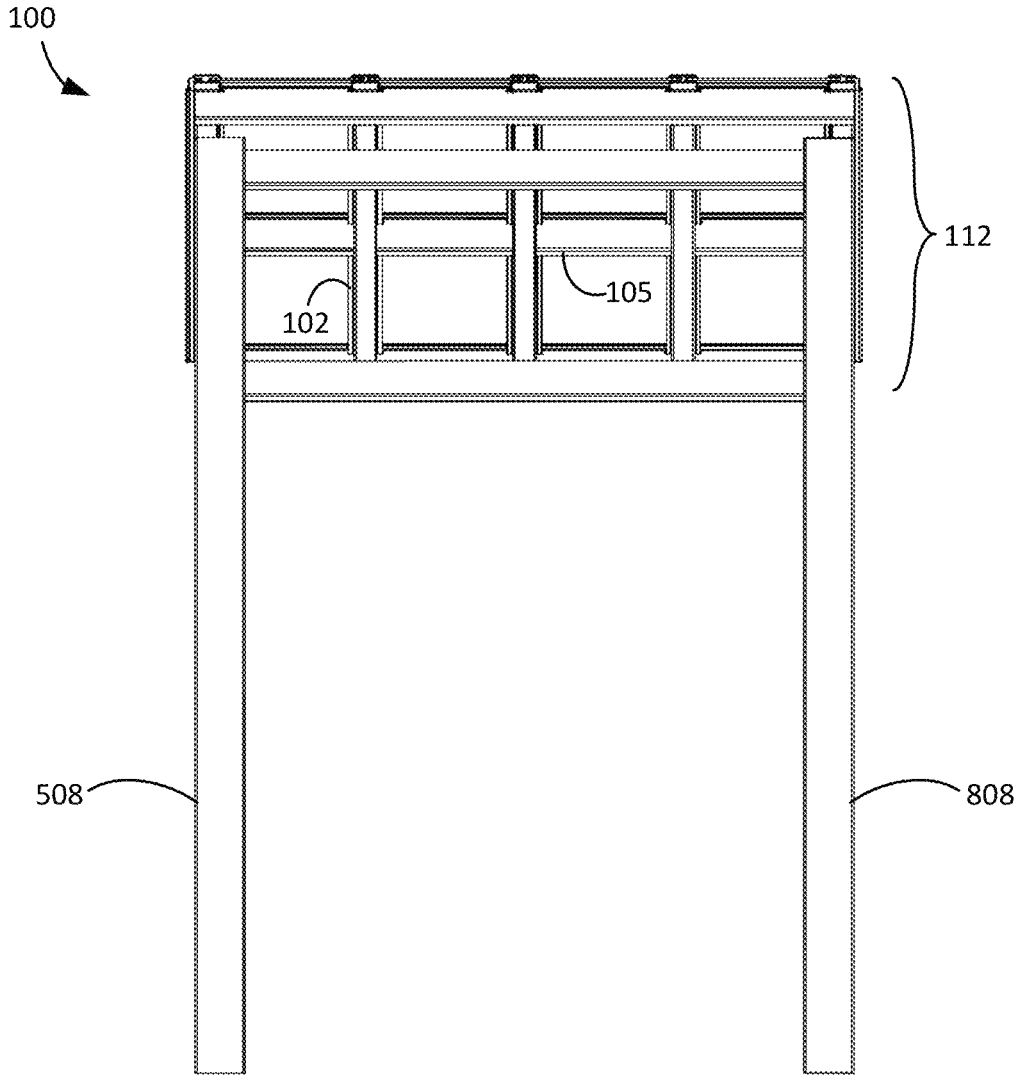
FIG. 8 illustrates a back elevation view of the solar energy-producing cover of FIG. 1 including the example glazing and condensation system for solar and glass roof panels in accordance with various embodiments of the present inventive concept.

FIG. 8 illustrates a back elevation view of the solar energy-producing cover 100 of FIG. 1 including the example glazing and condensation system 112 for solar and glass roof panels (e.g., 130*a*, 130*b*, 132*a*, 132*b*) in accordance with various embodiments of the present inventive concept. The solar energy-producing cover 100 can include one or more beams (e.g., 508, 808) to hold up and support the solar energy-producing cover 100. In addition, the solar energy-producing cover 100 can include the one or more mullions 102, and/or the one or more purlins 105, for example. It will be understood that the solar energy-producing cover 100 can include any suitable number of mullions, solar panels, glass panels, or the like, as described in detail herein.

Figure 9:
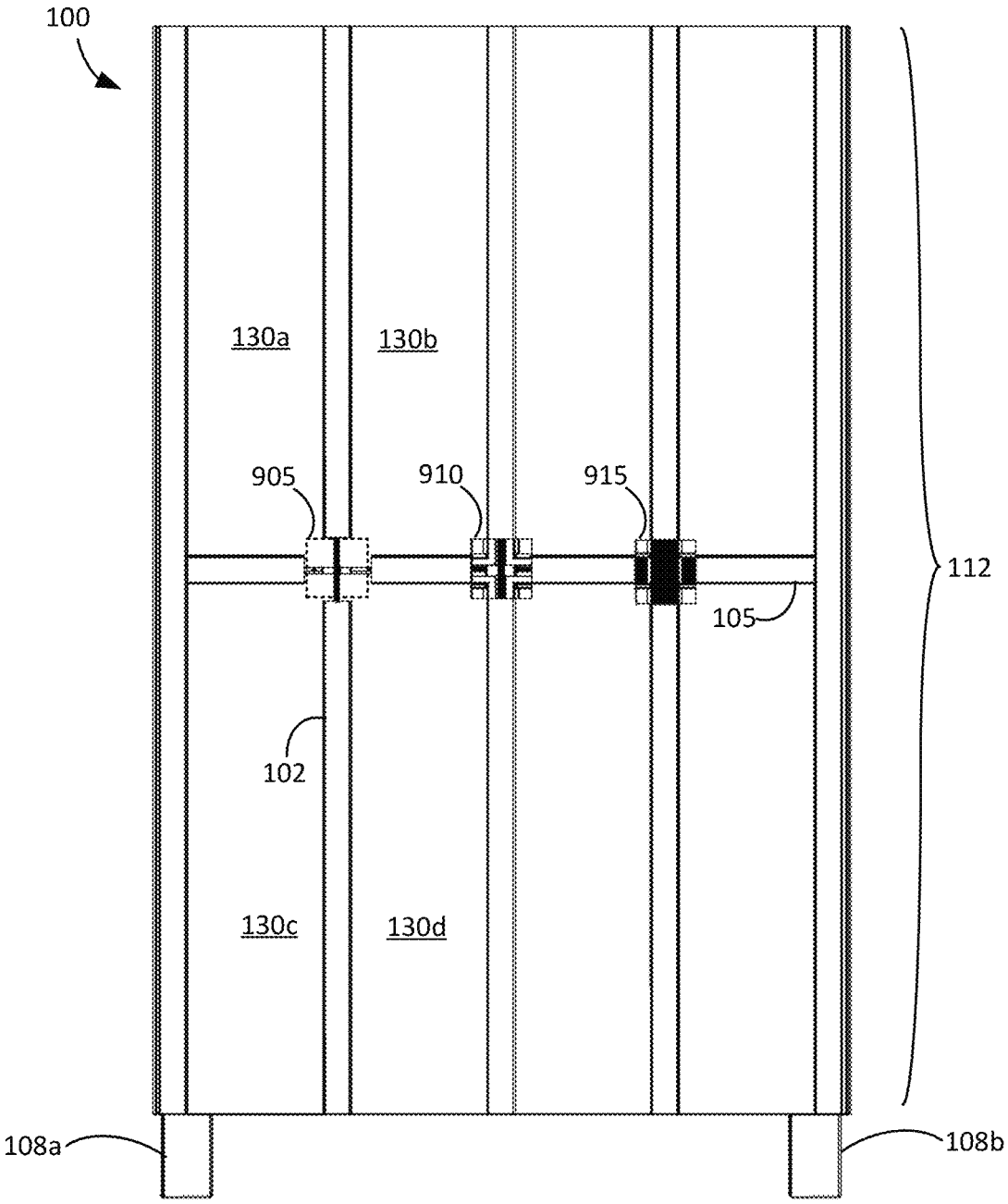
FIG. 9 illustrates another front elevation view of the solar energy-producing cover of FIG. 1 including the example glazing and condensation system for solar and glass roof panels, and various example layered views of cutouts from the glazing and condensation system in accordance with various embodiments of the present inventive concept.

FIG. 9 illustrates another front elevation view of the solar energy-producing cover 100 of FIG. 1 including the example glazing and condensation system 112 for solar and glass roof panels (e.g., 130*a*, 130*b*, 130*c*, 130*d*), and various example layered views of cutouts (e.g., 905, 910, 915) from the glazing and condensation system 112 in accordance with various embodiments of the present inventive concept. Details of each of the layered cutouts (e.g., 905, 910, 915) are provided in FIGS. 10, 11, and 12, which are described below.

Figure 10:
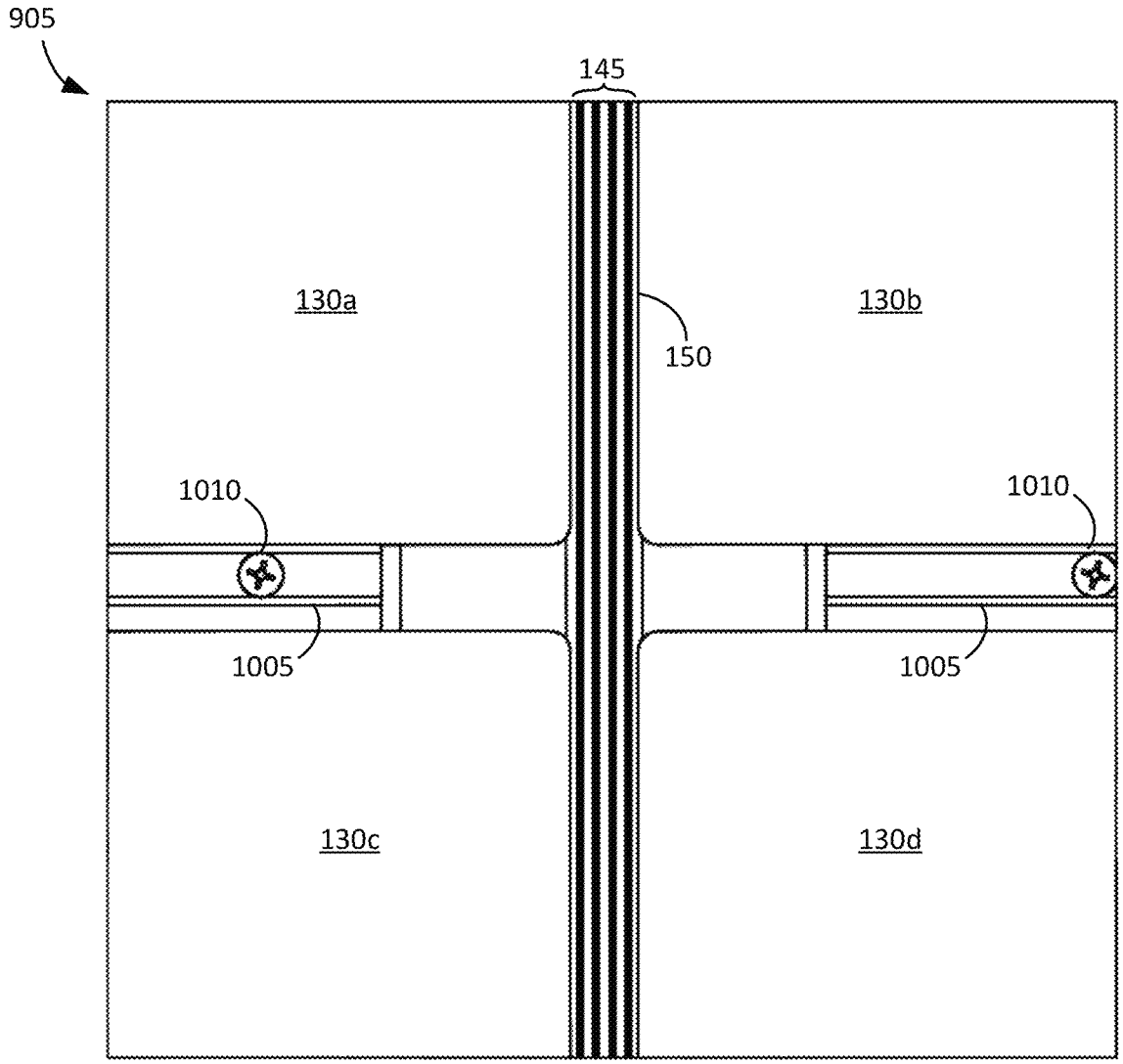
FIG. 10 illustrates a first layered view of the cutout of a section of the example glazing and condensation system of FIG. 9 including the one or more solar panels in accordance with various embodiments of the present inventive concept.

FIG. 10 illustrates a first layered view of the cutout 905 of a section of the example glazing and condensation system 112 of FIG. 9 including the one or more solar panels (e.g., 130*a*, 130*b*, 130*c*, 130*d*) in accordance with various embodiments of the present inventive concept. The cutout 905 shows the one or more wire orifices 145 of the wire casing 150 extending along the length of a mullion (e.g., 102 of FIG. 9). The one or more wires 148 (of FIG. 1) can be disposed within the one or more wire orifices 145, and connected to the one or more solar panels (e.g., 130*a*, 130*b*, 130*c*, 130*d*). One or more setting structures 1005 can be secured to the one or more purlins (e.g., 105 of FIG. 9). In some embodiments, the one or more setting structures 1005 are screwed into the one or more purlins (e.g., 105 of FIG. 9) using one or more screws 1010. The one or more setting structures 1005 can support and take the weight of the one or more solar panels (e.g., 130*a*, 130*b*, 130*c*, 130*d*).

Figure 11:
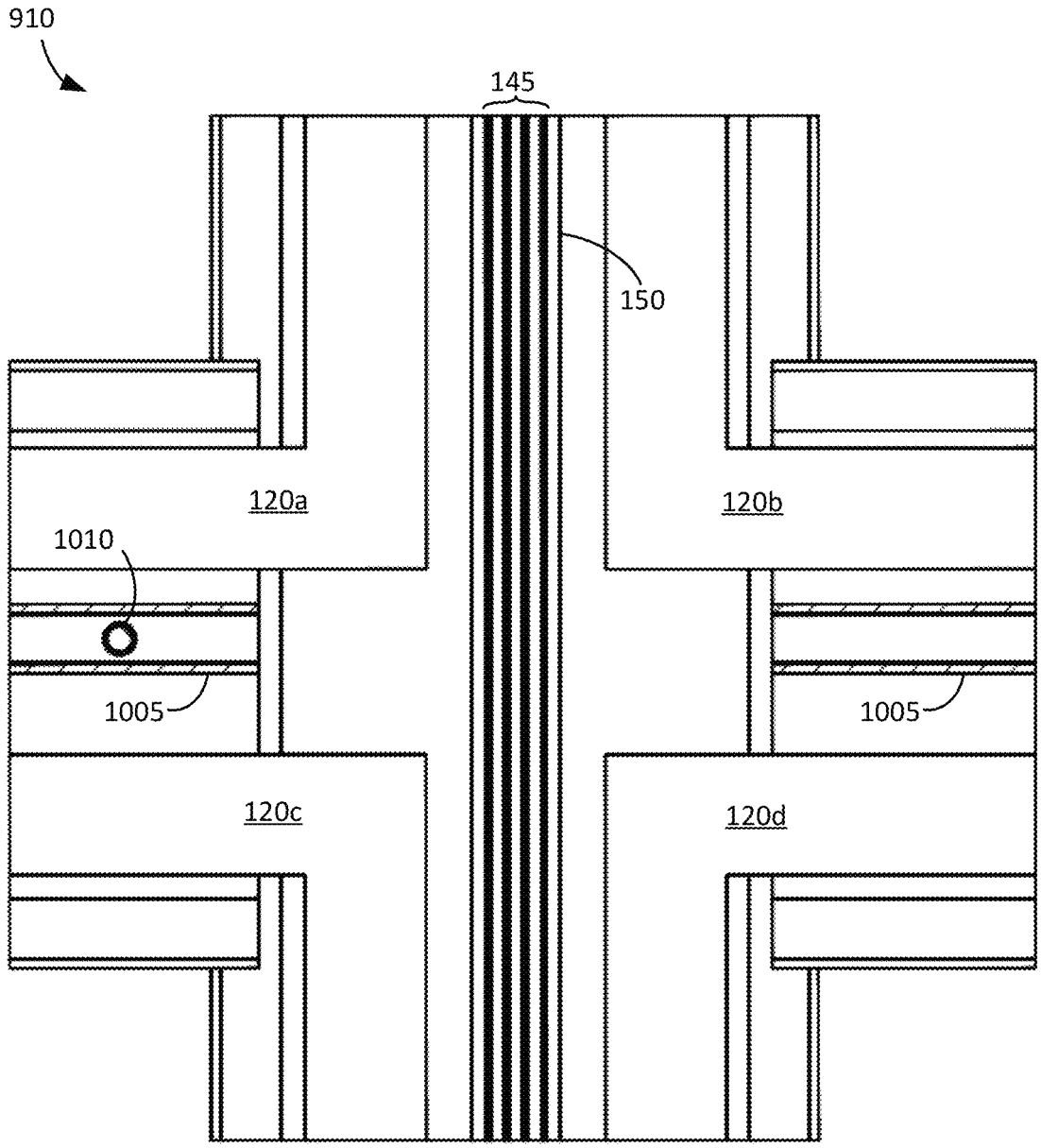
FIG. 11 illustrates a second layered view of the cutout of a section of the example glazing and condensation system of FIG. 9 without showing the one or more solar panels in accordance with various embodiments of the present inventive concept.

FIG. 11 illustrates a second layered view of the cutout 910 of a section of the example glazing and condensation system 112 of FIG. 9 without showing the one or more solar panels (e.g., 130*a*, 130*b*, 130*c*, 130*d*) in accordance with various embodiments of the present inventive concept. The cutout 910 shows the one or more wire orifices 145 of the wire casing 150 extending along the length of a mullion (e.g., 102 of FIG. 9). Also shown in the cutout 910 are sections of the double-sided tape (e.g., 120*a*, 120*b*, 120*c*, and 120*d*). The one or more solar panels (e.g., 130*a*, 130*b*, 130*c*, 130*d*) are not shown in this cutout. As mentioned above, the double-sided tape can be Very High Bond Tape such as 3M™ VHB™ tape. In addition, as shown in the cutout 910, the one or more setting structures 1005 can be secured to the one or more purlins (e.g., 105 of FIG. 9). In some embodiments, the one or more setting structures 1005 are screwed into the one or more purlins (e.g., 105 of FIG. 9) using one or more screws 1010. The one or more setting structures 1005 can support and take the weight of the one or more solar panels (e.g., 130*a*, 130*b*, 130*c*, 130*d*).

Figure 12:
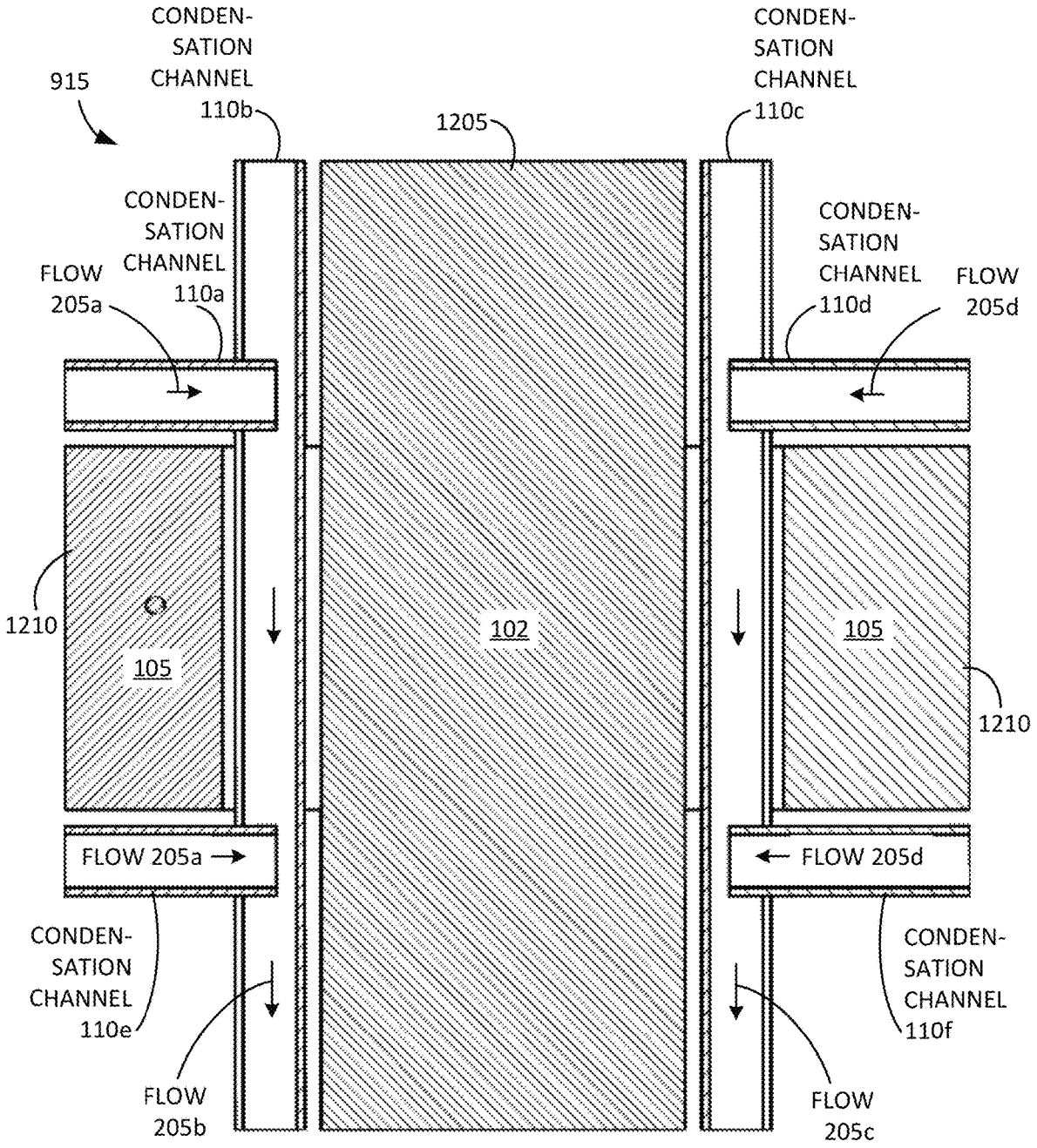
FIG. 12 illustrates a third layered view of the cutout of a section of the example glazing and condensation system of FIG. 9 without showing the one or more solar panels, and without showing double-sided tape in accordance with various embodiments of the present inventive concept.

FIG. 12 illustrates a third layered view of the cutout 915 of a section of the example glazing and condensation system 112 of FIG. 9 without showing the one or more solar panels (e.g., 130*a*, 130*b*, 130*c*, 130*d*), and without showing double-sided tape (e.g., 120*a*, 120*b*, 120*c*, and 120*d*) in accordance with various embodiments of the present inventive concept. Rather, the cutout 915 shows base metal 1205 of the one or more mullions 102, and base metal 1210 of the one or more purlins 105. The cutout 915 also shows condensation collection channels (e.g., 110*a*, 110*b*, 110*c*, 110*d*, 110*e*, and 110*f*) of the glazing and condensation system 112, and the various directional flows of condensation and other drippage. For example, the cutout 915 shows the condensation collection channels 110*a* and 110*e* with condensation flow 205*a*. The cutout 915 also shows the condensation collection channel 110*b* with condensation flow 205*b*. The cutout 915 also shows the condensation collection channels 110*c* with condensation flow 205*c*. The cutout 915 also shows the condensation collection channels 110*d* and 110*f* with condensation flow 205*d*. As can be seen, the condensation and other drippage can flow from the condensation collection channels associated with the purlin 105 into the condensation collection channels associated with the mullion 102, as shown by the flow arrows 105*a* and 205*d*. The condensation and other drippage can flow down the condensation collection channels associated with the mullion 102 with the assistance of gravity, and off of the solar energy-producing cover 100, as shown by the flow arrows 205*b* and 205*c*.

Accordingly, the glazing and condensation system 112 can provide a watertight structure that is efficient to construct and assemble, while enclosing and hiding view of the wires. Any liquid condensate can be captured and drained away from the structure to stop drippage from falling beneath the solar energy-producing cover 100.

Reference is now made to FIGS. 1 through 12.

Some embodiments include glazing and condensation system 112 for roof panels. The system 112 can include a mullion 102. The system 112 can include a first roof panel (e.g., 130*a*) disposed at least partially above the mullion 102. The system 112 can include a second roof panel (e.g., 130*b*) disposed at least partially above the mullion 102. The system 112 can include a first section of double-sided tape (e.g., 120*a*) disposed between the first roof panel (e.g., 130*a*) and the mullion 102 to adhere the first roof panel 130*a* to the mullion 102. The system 112 can include a second section of double-sided tape (e.g., 120*b*) disposed between the second roof panel (e.g., 130*b*) and the mullion 102 to adhere the second roof panel 130*b* to the mullion 102. In some embodiments, the first roof panel (e.g., 130*a*) is a first solar panel and the second roof panel (e.g., 130*b*) is a second solar panel. In some embodiments, the first roof panel (e.g., 130*a*) is a first glass panel and the second roof panel (e.g., 130*b*) is a second glass panel. In some embodiments, the double-sided tape is at least 0.15 millimeters thick. In some embodiments, the double-sided tape has a tensile strength of the double-sided tape is at least 70 lbs/inch$^2$. In some embodiments, the double-sided tape has a peel adhesion of the double-sided tape is at least 14 lbs/inch.

The system 112 can include a first condensation collection channel (e.g., 110*b*) arranged in parallel to the mullion 102. In some embodiments, the first condensation collection channel 110*b* is disposed at least partially beneath at least one of the first roof panel (e.g., 130*a*) or the second roof panel (e.g., 130*b*). The system 112 can include a second condensation collection channel (e.g., 110*c*) arranged in parallel to the mullion 102. In some embodiments, the second condensation collection channel 110*c* is disposed at least partially beneath at least one of the first roof panel 130*a* or the second roof panel 130*b*.

The system 112 can include a third condensation collection channel (e.g., 110*a*) arranged perpendicular to the mullion 102. In some embodiments, the third condensation collection channel 110*a* is disposed at least partially beneath the first roof panel 130*a* and at least partially above the first condensation collection channel 110*b*. The system 112 can include a fourth condensation collection channel (e.g., 110*d*) arranged perpendicular to the mullion 102. In some embodiments, the fourth condensation collection channel 110*d* is disposed at least partially beneath the second roof panel 130*a* and at least partially above the second condensation collection channel 110*c*.

In some embodiments, the third condensation collection channel 110*a* is configured to collect at least one of condensation or drippage from the first roof panel 130*a*, and to cause the at least one of the condensation or the drippage to be substantially emptied into the first condensation collection channel 110*b*. In some embodiments, the fourth condensation collection channel 110*d* is configured to collect at least one of the condensation or the drippage from the second roof panel 130*b*, and to cause the at least one of the condensation or the drippage to be substantially emptied into the second condensation collection channel 110*c*.

The system 112 can include a purlin (e.g., 105) that is arranged perpendicular to the mullion 102. In some embodiments, the third condensation collection channel 110*a* is arranged in parallel to the purlin 105. In some embodiments, the fourth condensation collection channel 110*d* is arranged in parallel to the purlin 105.

The system 112 can include a wire casing 150 arranged in parallel to the mullion 102. In some embodiments, the wire casing includes one or more wire orifices 145. In some embodiments, the wire casing 150 is disposed atop the mullion 102, and adjacent to the first roof panel 130*a* and the second roof panel 130*b*. The system 112 can include a third section of double-sided tape (e.g., 140) disposed between the wire casing 150 and the mullion 102 to adhere the wire casing 150 to the mullion 102. The system 112 can include a threshold cap 155 disposed atop the wire casing 150, atop at least a portion of the first roof panel 130*a*, and atop at least a portion of the second roof panel 130*b*.

The system 112 can include a fourth section of double-sided tape (e.g., 135) disposed between the threshold cap 155 and the first roof panel 130, and a fifth section of double-sided tape (e.g., 135) disposed between the threshold cap 155 and the second roof panel 130*b*. The system 112 can include a mullion cap (e.g., 410) disposed atop the threshold cap 155. The system 112 can include a first purlin cap (e.g., 405) disposed atop at least a portion of the first roof panel 130*a*. The system 112 can include a second purlin cap (e.g., 405) disposed atop at least a portion of the second roof panel 130*b*. The system 112 can include a sixth section of double-sided tape (e.g., 160) disposed between the first purlin cap (e.g., 405) and the first roof panel 130*a*. The system 112 can include a seventh section of double-sided tape (e.g., 160) disposed between the second purlin cap (e.g., 405) and the second roof panel 130*b*.

The system 112 can include one or more one wires (e.g., 148) disposed at least partially inside the one or more wire orifices (e.g., 145). In some embodiments, the one or more wires 148 are connected to at least one of the first roof panel 130*a* or the second roof panel 130*b*.

Some embodiments include a method for making a glazing and condensation system for roof panels. The method can include arranging a mullion, arranging a first roof panel at least partially above the mullion, arranging a second roof panel at least partially above the mullion, arranging a first section of double-sided tape between the first roof panel and the mullion, adhering the first roof panel to the mullion, arranging a second section of double-sided tape between the second roof panel and the mullion, and adhering the second roof panel to the mullion.

The method can further include arranging a first condensation collection channel in parallel to the mullion, wherein the first condensation collection channel is arranged at least partially beneath the first roof panel. The method can further include arranging a second condensation collection channel in parallel to the mullion, wherein the second condensation collection channel is arranged at least partially beneath the second roof panel. The method can further include arranging a third condensation collection channel perpendicular to the mullion, wherein the third condensation collection channel is arranged at least partially beneath the first roof panel and at least partially above the first condensation collection channel. The method can further include arranging a fourth condensation collection channel perpendicular to the mullion, wherein the fourth condensation collection channel is arranged at least partially beneath the second roof panel and at least partially above the second condensation collection channel.

The method can further include arranging a purlin to be perpendicular to the mullion, arranging the third condensation collection channel to be in parallel to the purlin, arranging the fourth condensation collection channel to be in parallel to the purlin, arranging a wire casing to be in parallel to the mullion, wherein the wire casing includes one or more wire orifices, arranging the wire casing atop the mullion, and adjacent to the first roof panel and the second roof panel, arranging a third section of double-sided tape between the wire casing and the mullion, adhering the wire casing to the mullion, arranging a threshold cap atop the wire casing, atop at least a portion of the first roof panel, and atop at least a portion of the second roof panel, arranging a fourth section of double-sided tape between the threshold cap and the first roof panel, arranging a fifth section of double-sided tape between the threshold cap and the second roof panel, arranging a mullion cap atop the threshold cap, arranging a first purlin cap atop at least a portion of the first roof panel, arranging a second purlin cap atop at least a portion of the second roof panel, arranging a sixth section of double-sided tape between the first purlin cap and the first roof panel, adhering the first purlin cap to at least a portion of the first roof panel, arranging a seventh section of double-sided tape between the second purlin cap and the second roof panel, and adhering the second purlin cap to at least a portion of the second roof panel.

Having described and illustrated the principles of the inventive concept with reference to illustrated embodiments, it will be recognized that the illustrated embodiments can be modified in arrangement and detail without departing from such principles, and can be combined in any desired manner. And although the foregoing discussion has focused on particular embodiments, other configurations are contemplated. In particular, even though expressions such as "according to an embodiment of the invention" or the like are used herein, these phrases are meant to generally reference embodiment possibilities, and are not intended to limit the inventive concept to particular embodiment configurations. As used herein, these terms can reference the same or different embodiments that are combinable into other embodiments.

Consequently, in view of the wide variety of permutations to the embodiments described herein, this detailed description and accompanying material is intended to be illustrative only, and should not be taken as limiting the scope of the inventive concept. What is claimed as the invention, therefore, is all such modifications as may come within the scope and spirit of the following claims and equivalents thereto.

The invention claimed is:

1. A glazing and condensation system for roof panels, comprising:

a mullion;

a first roof panel disposed at least partially above the mullion;

a second roof panel disposed at least partially above the mullion; and a first section of double-sided tape disposed between the first roof panel and the mullion to adhere the first roof panel to the mullion;

a second section of double-sided tape disposed between the second roof panel and the mullion to adhere the second roof panel to the mullion;

a wire casing arranged in parallel to the mullion, wherein the wire casing includes one or more wire orifices; and a third section of double-sided tape disposed between the wire casing and the mullion to adhere the wire casing to the mullion, wherein the wire casing is disposed atop the mullion, and adjacent to the first roof panel and the second roof panel.

2. The glazing and condensation system for roof panels of claim 1, wherein the first roof panel is a first solar panel and the second roof panel is a second solar panel.

3. The glazing and condensation system for roof panels of claim 1, wherein the first roof panel is a first glass panel and the second roof panel is a second glass panel.

4. The glazing and condensation system for roof panels of claim 1, wherein:

the double-sided tape is at least 0.15 millimeters thick;

a tensile strength of the double-sided tape is at least 70 $lbs/inch^2$; and a peel adhesion of the double-sided tape is at least 14 lbs/inch.

5. The glazing and condensation system for roof panels of claim 1, further comprising a condensation collection channel arranged in parallel to the mullion, wherein the condensation collection channel is disposed at least partially beneath at least one of the first roof panel or the second roof panel.

6. The glazing and condensation system for roof panels of claim 5, wherein the condensation collection channel is a first condensation collection channel, the glazing and condensation system further comprising a second condensation collection channel arranged in parallel to the mullion, wherein the second condensation collection channel is disposed at least partially beneath at least one of the first roof panel or the second roof panel.

7. The glazing and condensation system for roof panels of claim 6, further comprising:

a third condensation collection channel arranged perpendicular to the mullion, wherein the third condensation collection channel is disposed at least partially beneath the first roof panel and at least partially above the first condensation collection channel; and a fourth condensation collection channel arranged perpendicular to the mullion, wherein the fourth condensation collection channel is disposed at least partially beneath the second roof panel and at least partially above the second condensation collection channel.

8. The glazing and condensation system for roof panels of claim 7, wherein:

the third condensation collection channel is configured to collect at least one of condensation or drippage from the first roof panel, and to cause the at least one of the condensation or the drippage to be substantially emptied into the first condensation collection channel; and the fourth condensation collection channel is configured to collect at least one of the condensation or the drippage from the second roof panel, and to cause the at least one of the condensation or the drippage to be substantially emptied into the second condensation collection channel.

9. The glazing and condensation system for roof panels of claim 7, further comprising a purlin that is arranged perpendicular to the mullion, wherein:

the third condensation collection channel is arranged in parallel to the purlin; and the fourth condensation collection channel is arranged in parallel to the purlin.

10. The glazing and condensation system for roof panels of claim 1, further comprising a threshold cap disposed atop the wire casing, atop at least a portion of the first roof panel, and atop at least a portion of the second roof panel.

11. The glazing and condensation system for roof panels of claim 10, further comprising a fourth section of double-sided tape disposed between the threshold cap and the first roof panel, and a fifth section of double-sided tape disposed between the threshold cap and the second roof panel.

12. The glazing and condensation system for roof panels of claim 11, further comprising:

a mullion cap disposed atop the threshold cap;

a first purlin cap disposed atop at least a portion of the first roof panel;

a second purlin cap disposed atop at least a portion of the second roof panel;

a sixth section of double-sided tape disposed between the first purlin cap and the first roof panel; and a seventh section of double-sided tape disposed between the second purlin cap and the second roof panel.

13. The glazing and condensation system for roof panels of claim 1, further comprising one or more one wires disposed at least partially inside the one or more wire orifices, wherein the one or more wires are connected to at least one of the first roof panel or the second roof panel.

14. A method for making a glazing and condensation system for roof panels, the method comprising:

arranging a mullion;

arranging a first roof panel at least partially above the mullion;

arranging a second roof panel at least partially above the mullion;

arranging a first section of double-sided tape between the first roof panel and the mullion;

adhering the first roof panel to the mullion;

arranging a second section of double-sided tape between the second roof panel and the mullion;

adhering the second roof panel to the mullion;

arranging a first condensation collection channel in parallel to the mullion, wherein the first condensation collection channel is arranged at least partially beneath the first roof panel;

arranging a second condensation collection channel in parallel to the mullion, wherein the second condensation collection channel is arranged at least partially beneath the second roof panel;

arranging a third condensation collection channel perpendicular to the mullion, wherein the third condensation collection channel is arranged at least partially beneath the first roof panel and at least partially above the first condensation collection channel;

arranging a fourth condensation collection channel perpendicular to the mullion, wherein the fourth condensation collection channel is arranged at least partially beneath the second roof panel and at least partially above the second condensation collection channel;

arranging a purlin to be perpendicular to the mullion;

arranging the third condensation collection channel to be in parallel to the purlin;

arranging the fourth condensation collection channel to be in parallel to the purlin;

arranging a wire casing to be in parallel to the mullion, wherein the wire casing includes one or more wire orifices;

arranging the wire casing atop the mullion, and adjacent to the first roof panel and the second roof panel;

arranging a third section of double-sided tape between the wire casing and the mullion;

adhering the wire casing to the mullion;

arranging a threshold cap atop the wire casing, atop at least a portion of the first roof panel, and atop at least a portion of the second roof panel;

arranging a fourth section of double-sided tape between the threshold cap and the first roof panel;

arranging a fifth section of double-sided tape between the threshold cap and the second roof panel;

arranging a mullion cap atop the threshold cap;

arranging a first purlin cap atop at least a portion of the first roof panel;

arranging a second purlin cap atop at least a portion of the second roof panel;

arranging a sixth section of double-sided tape between the first purlin cap and the first roof panel;

adhering the first purlin can to at least a portion of the first roof panel;

arranging a seventh section of double-sided tape between the second purlin cap and the second roof panel; and adhering the second purlin can to at least a portion of the second roof panel.

* * * * *